United States Patent [19]

Karabin et al.

[11] Patent Number: 5,062,411

[45] Date of Patent: Nov. 5, 1991

[54] LOW PRESSURE DROP FIREPLACE HEAT EXCHANGER

[75] Inventors: Tadeusz Karabin, Huntington; Roy E. Mundy, Roann, both of Ind.

[73] Assignee: MAJCO Building Specialties, L.P., Huntington, Ind.

[21] Appl. No.: 551,199

[22] Filed: Jul. 11, 1990

[51] Int. Cl.[5] ..... F24B 1/188

[52] U.S. Cl. ..... 126/523; 126/521; 126/200; 165/164

[58] Field of Search ..... 126/521, 523, 531, 200, 126/312; 237/55; 165/164

[56] References Cited

U.S. PATENT DOCUMENTS

| | | | |
|---|---|---|---|
| 64,446 | 5/1867 | Redway | 126/531 |
| 1,383,506 | 7/1921 | Westerlund | 126/523 |
| 1,469,494 | 10/1923 | Buckler | 126/523 X |
| 1,488,195 | 3/1924 | Dawson | 126/523 |
| 1,766,601 | 6/1930 | Cesa | 126/523 |
| 4,056,091 | 11/1977 | Moncrieff-Yeates | 126/531 |
| 4,131,105 | 12/1978 | Moncrieff-Yeates | 126/531 X |
| 4,200,086 | 4/1980 | Kolb | 126/66 |
| 4,206,743 | 6/1980 | Niemela | 126/110 B |
| 4,226,526 | 5/1981 | Tolotti | 126/521 X |
| 4,319,557 | 3/1982 | Sietmann et al. | 126/110 R |
| 4,426,937 | 1/1984 | Sietmann et al. | 110/288 |
| 4,434,784 | 3/1984 | Van Patten | 126/312 |
| 4,465,055 | 8/1984 | Bortz | 126/502 |
| 4,515,145 | 5/1985 | Tallman et al. | 126/99 A |
| 4,519,376 | 5/1985 | Schoeff et al. | 126/121 |
| 4,558,688 | 12/1985 | Piazzetta | 126/67 |
| 4,612,908 | 9/1986 | Van Patten | 126/200 |
| 4,665,890 | 5/1987 | Drewsen | 126/77 |
| 4,854,198 | 8/1989 | Craver | 126/77 |
| 4,878,478 | 11/1989 | Johnson | 126/61 |

FOREIGN PATENT DOCUMENTS

| | | | |
|---|---|---|---|
| 307038 | 3/1989 | European Pat. Off. | 126/523 |
| 2056650 | 3/1981 | United Kingdom . | |

*Primary Examiner*—Allen J. Flanigan

*Attorney, Agent, or Firm*—Hoffmann & Baron

[57] ABSTRACT

A heat exchanger for use in a fireplace assembly having walls surrounding a fire combustion chamber, an air passage provided therein and a flue assembly for exhausting combustion chamber effluent. The heat exchanger includes a housing adapted to be mounted in the fire combustion chamber and communicating with the air passage. The housing has a first housing wall, a second housing wall and intermediate walls connecting the first and second housing walls. The first housing wall has an opening therein to receive combustion chamber effluent. The second housing wall has an opening for emission of combustion chamber effluent which is adapted for communication with the flue of the fireplace assembly for exhaust of the combustion chamber effluent from the fireplace assembly. Intermediate walls connect the first and second housing walls in a spaced relation. Diversion means are fixed in the housing to form at least one elongated heat exchange surface to guide and direct combustion chamber effluent through the heat exchanger along a tortuous path and provide extended heat transfer surfaces. The extended heat transfer surfaces serve to provide heat to a first air conduit formed between the first housing wall and the diversion means, a second air conduit within the diversion means and a third air conduit formed between second housing wall and the diversion means. The air passage is in fluid communication with the air conduits and the air conduits are in fluid communication with the atmosphere.

17 Claims, 8 Drawing Sheets

LOW PRESSURE DROP FIREPLACE HEAT EXCHANGER

BACKGROUND OF THE INVENTION

1. Field of Invention

The present invention relates to heat exchangers for gas and wood fireplaces, and, in particular, it embraces the obstruction of a flow of flue gas by a thin walled air conduit. The obstruction increases the amount of time in which the hot flue gas contacts the air conduit and increases the heat transfer surface area.

2. Description of Related Art

Fireplace heat exchangers are well known. However, the amount of time in which the hot flue gas is in contact with the heat transfer surface area (and the quantity of heat transferred) is generally limited. Accordingly, the amount of heat transfer is limited as is the heating capacity of the fireplace unit.

U.S. Pat. No. 4,878,478 to Johnson discloses the use of a heat exchange chamber for circling air about an inner shell to heat the circulated air. Johnson further teaches the use of fans to aid in the flow of air. The heat exchange chamber comprises a passageway which surrounds a wood fire within the fire chamber. However, such a heat exchange chamber suffers from several significant shortcomings and drawbacks. In particular, this prior art heat exchange chamber is not insertable into a standard fireplace unit. Also, the heat exchange surface area is limited as is the time in which the hot flue gases contact the surface which transfers heat into the air to be heated.

U.S. Pat. No. 4,854,298 to Craver discloses a wood burning stove having a lower conduit, a vertical rear conduit and an upper conduit. Ambient air enters the lower conduit and receives heat from the floor of the combustion chamber. The heated air is transferred from the rear conduit to an upper bonnet. The upper bonnet has two diverging side walls which direct the heated air through two forward facing outlets. A fan is used to aid in the flow of air through the conduit. However, such a heat exchange chamber suffers from several significant shortcomings and drawbacks. In particular, the heat exchange surface area is limited as is the time in which the hot flue gases contact the surface which transfers heat into the air to be heated. Also, this prior art heat exchange chamber is not insertable into a conventional fireplace unit.

U.S. Pat. No. 4,665,890 to Drewsen discloses a fireplace insert which routes smoke, created in the process of burning, through a smoke duct work. Heat is transferred from the duct work directly to the outside of the fireplace unit. Heat is also transferred to ambient air within an air duct. The air duct follows the sides and back of the firebox. Such a heat exchange chamber suffers from several significant shortcomings and drawbacks. In particular, this prior art heat exchange chamber is not insertable into a conventional fireplace unit. Also, the heat exchange surface area is not maximized. Further, the time in which the hot flue gases contact the surface which transfers heat into the air to be heated is not maximized.

U.S. Pat. No. 4,558,688 to Piazzetta discloses a fireplace-heater having air inlet grids at the top of the fireplace heater. The air inlet grids lead to two vertical chambers which follow the vertical portion of the burner unit. The vertical chambers lead to an intake chamber. The intake chamber is connected to the suction side of a ventilating unit. The delivery side of the ventilating unit opens, through flexible hoses, to grids located in the lower portion of the heater. The grids discharge heated air. The vertical chambers encompass two pairs of chambers. The chambers connect to form a U-shape. Hot flue gas travels upward and enters the aforementioned chambers. The hot flue gas travels down the chambers and is routed upwardly to a second chamber to be discharged through a chimney union. However, such a heat exchange chamber suffers from several significant shortcomings and drawbacks. In particular, this prior art heat exchange chamber is not insertable into a standard fireplace unit and it must follow the vertical portion of the burner.

U.S. Pat. No. 4,519,376 to Schoeff, et al. discloses a heat exchanger which divides a flow of air to be heated. One portion of the air passes through primary heat transfer surfaces and secondary heat transfer surfaces. Another portion passes between secondary heat transfer surfaces and the outer walls. The secondary heat transfer surface is heated by direct radiation from primary heat transfer surfaces which in turn heats the air there between. Thereafter, the heated secondary heat transfer surface heats the outer walls which in turn transfers the heat energy to the air passing there between. These heat transfer surfaces follow the lower back and top portions of the fireplace assembly. The unit is not insertable into a standard fireplace unit.

U.S. Pat. No. 4,515,145 to Tallman et al. discloses a gas-fire condensing mode furnace having a heat exchanger. The heat exchanger is located in the air passage and transfers heat, from the products of combustion, to an air passage. The heat exchanger comprises an elongated conduit having a serpentine configuration with its intake end communicating with the gas burner enclosure. Air to be heated is drawn into an air passage by means of a blower and is caused to flow over the heat exchanger. Heat is extracted from the heat exchanger and the hot air is discharged through a hot air discharge duct located at the top of the furnace. Tallman et al. is not directed toward fireplace inserts. Further, such a heat exchange chamber suffers from several significant shortcomings and drawbacks. In particular, it is very bulky and is not insertable into a conventional fireplace unit.

U.S. Pat. No. 4,206,743 to Niemeia discloses a heating apparatus wherein the combustion chamber is at least partially surrounded by an air heating enclosure through which ambient air is forced by a fan for heating. Ambient heated air released through a heated air outlet located at the top of the stove. The ambient air is drawn into the heating enclosure through a lower portion of the unit. Niemeia does not relate to a fireplace insert. Further, such a heat exchange chamber suffers from several significant shortcomings and drawbacks. In particular, this prior art heat exchange chamber is not insertable into a conventional fireplace unit and is very bulky.

U.S. Pat. No. 4,200,086 to Kolb discloses an air to air heat exchanger insert for use in a wood burning stove or fireplace. The heat exchanger insert includes two chambers separated by a baffle plate. The baffle plate extends over a major portion of the length of the heat exchanger insert. The baffle plate forms a "U" shaped circulation pattern. Hot air travels under, around and over the insert and out through the flue connection. However, such a heat exchanger suffers from several significant shortcomings and drawbacks. In particular, this prior art heat exchanger requires the use of baffle plates which increases the number of steps in the manufacturing process.

Accordingly, none of the related art describes a parallel flow heat exchanger having a thin walled chamber, with a thin walled air conduit extending therethrough, a port for the introduction of hot flue gas and a port for the release of flue gas.

Nor does any of the related art describe a sinusoidal passageway embodiment, wherein ambient air from a lower air conduit of the heat exchanger is passed to a middle air conduit and then transferred to an upper air conduit for further heating and discharged into an area to be heated It is therefore an object of the present invention to provide a heat exchanger with a low air pressure drop and a high heat exchange.

It is a further object of the further invention to provide a more efficient heat exchanger for gas and wood fireplaces.

It is yet another object of the present invention to provide a heat exchanger which cools a portion of the fireplace.

It is an additional object of the present invention to provide a non-bulky heat exchanger which may be inserted into conventional gas and wood burning fireplaces.

SUMMARY OF THE INVENTION

These and other objects of the present invention are achieved by the present inventions which provides a low pressure drop heat exchanger for use in a fireplace assembly having walls surrounding a fire combustion chamber, an air passage provided therein and a flue assembly for exhausting combustion chamber effluent. The terms "passage" and "conduit" are used interchangeably herein. The heat exchanger includes a housing adapted to be mounted in the fire combustion chamber and communicating with the air passage. The housing has a first wall, a second wall and intermediate walls interconnecting the first and second housing walls in a spaced relation. The first housing wall has an opening therein to receive combustion chamber effluent. The second housing wall has an opening for emission of combustion chamber effluent and is adapted for communication with the flue of the fireplace assembly for exhaust of combustion chamber effluent from the fireplace assembly.

Diversion means are fixed in the housing to form at least one elongated heat exchange surface to guide and direct combustion chamber effluent through the heat exchanger along a tortuous path and provide extended heat transfer surfaces. The extended heat transfer surfaces transfer heat to air flowing through at least one air conduit. In a preferred embodiment there are three air conduits.

Preferably, the heat exchanger includes an air pump for aiding the flow of air through the air passage and through the air conduits . Suitably, the heat exchanger may include a base having a base conduit in fluid communication with the air passage. The diversion means may include an inspection window. Preferably, an air inlet is in fluid communication with the base conduit. An air outlet receives air passed through the air conduits. The air outlet discharges the heated air into an area to be heated. Suitably, the heat exchanger provides a low air pressure drop and a high heat exchange and is also insertable into a conventional gas or wood burning fireplace.

Preferably, the first housing wall, second housing wall and heat exchange surface are formed from material having good thermal conductivity such as a thin metal. In a preferred embodiment, the first housing wall and second housing wall are approximately parallel to each other.

The diversion means can include a chamber having a first chamber wall, a second chamber wall and intermediate chamber walls interconnecting the first and second chamber walls in a spaced relation. Preferably, the first chamber wall, second chamber wall and intermediate chamber walls are formed from a material having good thermal conductivity such as a thin metal. In a preferred embodiment the first housing wall, the first and second chamber walls of the diversion means and the second housing wall are approximately parallel to each other.

An alternative embodiment of the present invention includes a means for communicating a flow of air passed through the first air conduit to the second air conduit and a means for communicating a flow of air passed through the second air conduit to the third air conduit so as to form a continuous sinusoidal air passage in order to provide an extended heat transfer surface. The sinusoidal air passage is in fluid communication with the atmosphere.

Preferably, an air pump aids the flow of air through the sinusoidal air passage. Suitably, the heat exchanger may include having a base conduit in fluid communication with the air passage. The diversion means may include an inspection window. Preferably, an air inlet is in fluid communication with the base conduit. An air outlet receives air passed through the sinusoidal air passage and discharges the heated air into an area to be heated. Suitably, the heat exchanger provides a low air pressure drop, a high heat exchange and is insertable into a conventional gas or wood burning fireplace.

In a preferred embodiment the first housing wall, second housing wall and heat exchanger surface are formed from material having good thermal conductivity such as a thin metal. Preferably, the first housing wall and second housing wall are approximately parallel to each other.

Preferably, the diversion means includes a chamber having a first chamber wall, a second chamber wall and intermediate chamber walls interconnecting the first and second chamber walls in a spaced relation. Most preferably, the first chamber wall, second chamber wall and intermediate chamber walls are formed from material having good thermal conductivity such as a thin metal. In a preferred embodiment the first housing wall, the first and second chamber walls of the diversion means and the second housing wall are approximately parallel to each other. Suitably, the heat exchanger provides a low air pressure drop, a high heat exchange and is insertable into a conventional gas or wood burning fireplace.

In the method of the present invention heat produced in the combustion chamber of a fireplace assembly is exchanged to air to be heated by use of a heat exchanger. The heat exchanger is positioned in the fireplace in communication with combustion chamber effluent, effluent passing through the fireplace and the fireplace flue. Air to be heated is directed around and through the heat exchanger and into contact with the heat exchanger surfaces. Combustion chamber effluent is passed through the heat exchanger and then through the fireplace flue. Prior to passing through the flue, the combustion chamber effluent is directed along at least one elongated heat exchange surface. The elongated heat exchange surface provides a tortuous path and extended heat transfer surfaces for transferring heat to the air flowing around and through the heat exchanger.

In a preferred embodiment air is passed through an air conduit beneath the elongated heat exchange surface, through a second air conduit within the elongated heat exchange surface and through a third air conduit above the elongated heat exchange surface. Preferably, the flow of air is aided by an air pump. Suitably, the heated air is discharged into an area to be heated.

In an alternative embodiment, a flow of air is passed through the first air conduit and into the second air conduit. The flow of air is then passed through the second air conduit to the third air conduit. Preferably, the flow of air is aided by an air pump. Suitably, the heated air is discharged into an area to be heated.

For a better understanding of the present invention, reference is made to the following description, taken in conjunction with the following figures, the scope of which is pointed out in the appended claims.

DETAILED DESCRIPTION OF THE PREFERRED EMBODIMENTS

Figure 7:
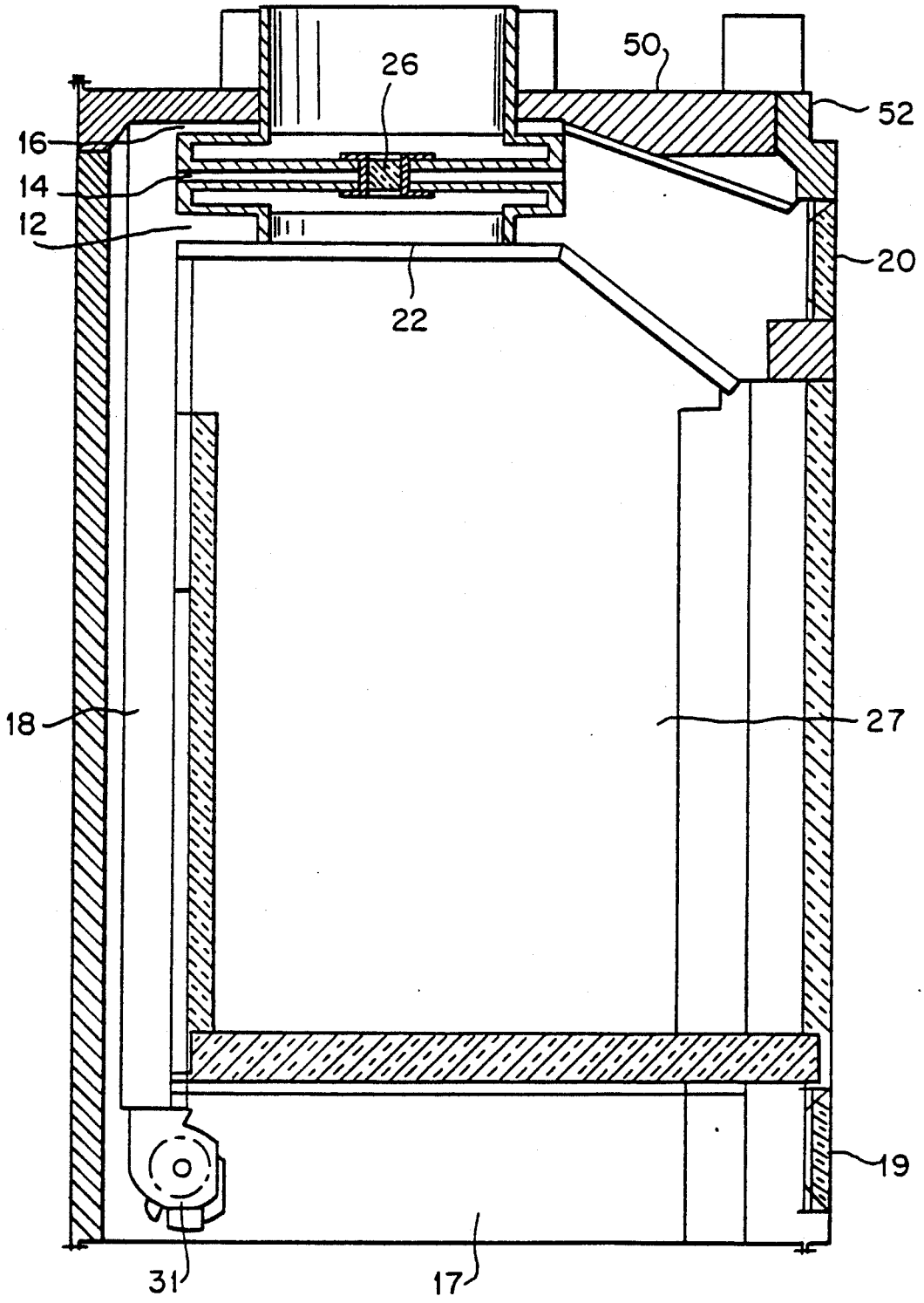
FIG. 7 is a cut away view of a fireplace having the parallel flow heat exchanger of FIG. 1.
Figure 8:
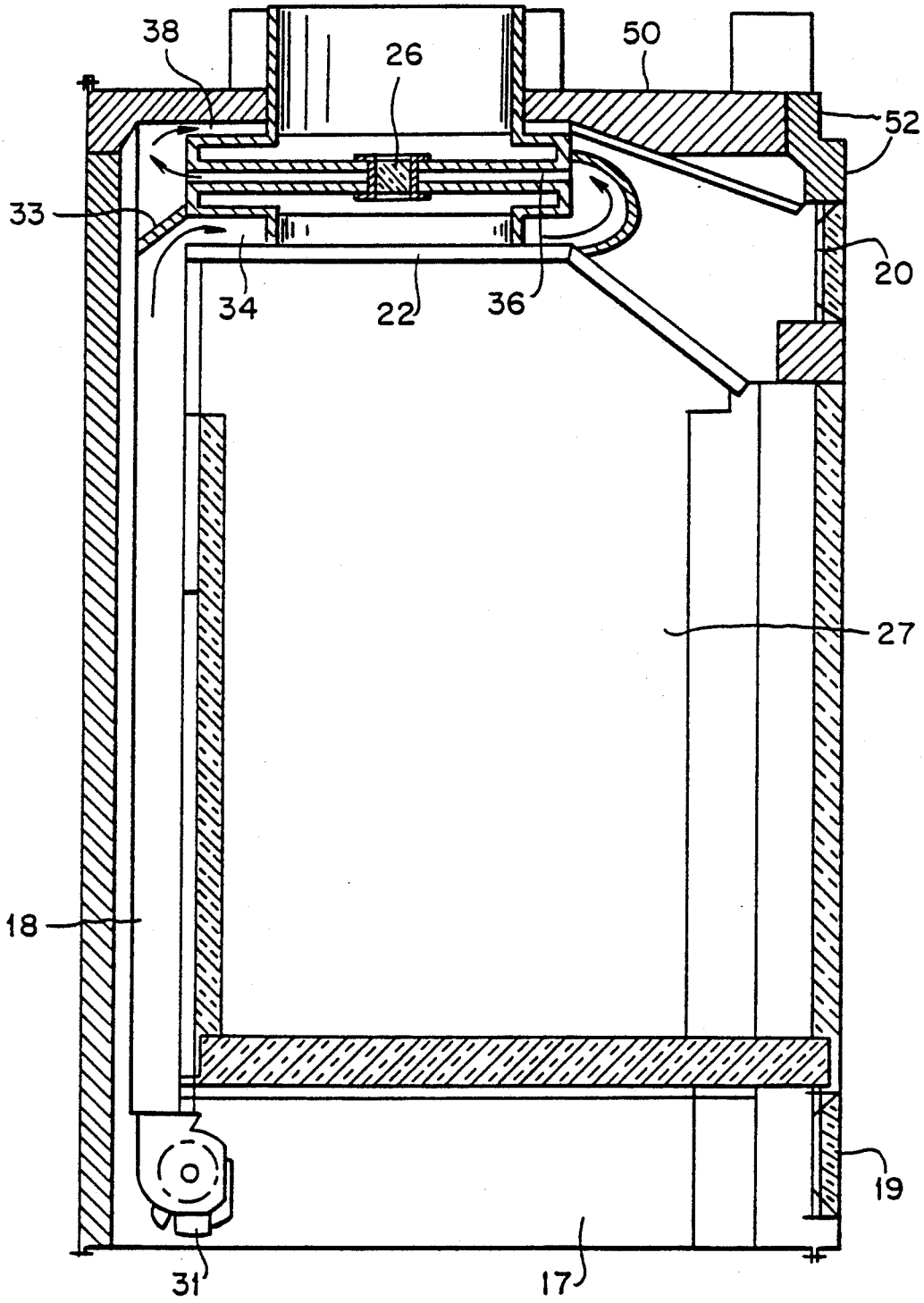
FIG. 8 is a cut away view of a sinusoidal passage heat exchanger of FIG. 4.

A parallel flow low pressure drop heat exchanger 10 of the present invention is illustrated in FIGS. 1–3 and FIG. 7. The parallel flow low pressure drop heat exchanger 10 includes a lower air conduit 12, a middle air conduit 14 and an upper air conduit 16. Conduit 18 is in fluid communication with lower air conduit 12, middle air conduit 14, and upper air conduits 16 and serves to provide air to be heated to the conduits 12, 14 and 16. As illustrated in FIG. 7, conduit 18 is in fluid communication with base conduit 17 and air inlet 19. Hot air outlet 20 is in fluid communication with conduits 12, 14 and 16 and serves to discharge heated air from these conduits into an area to be heated.

Figure 9:
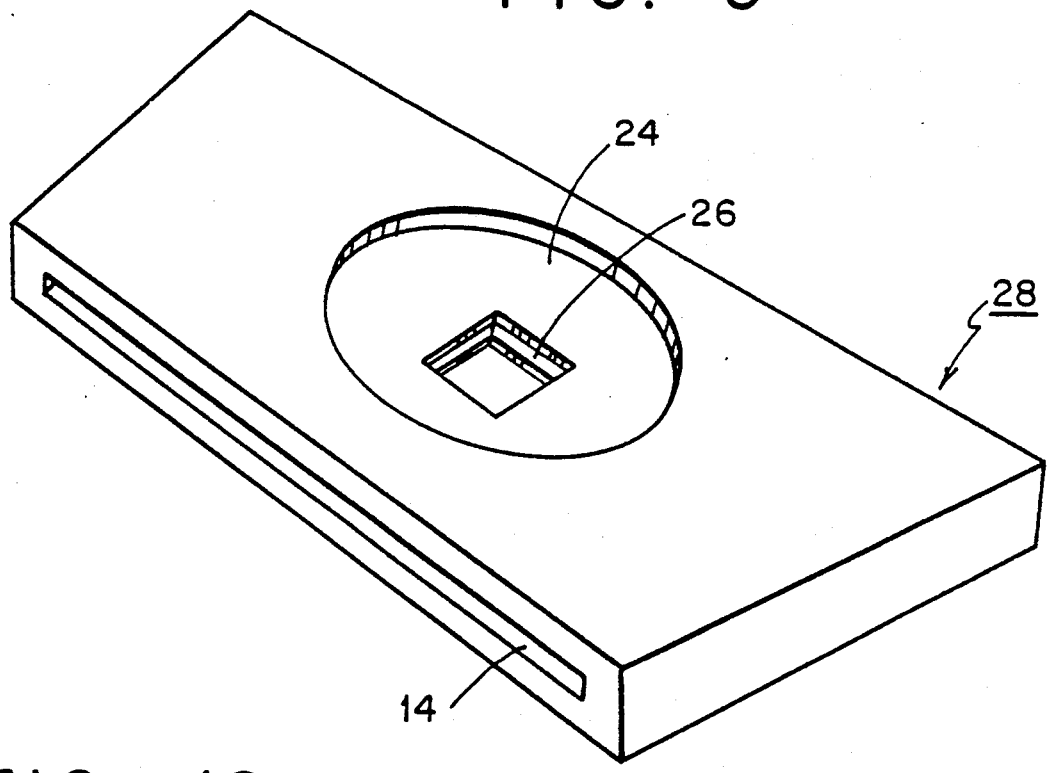
FIG. 9 is a back perspective view of the chamber of the parallel flow heat exchange chamber of the present invention.
Figure 10:
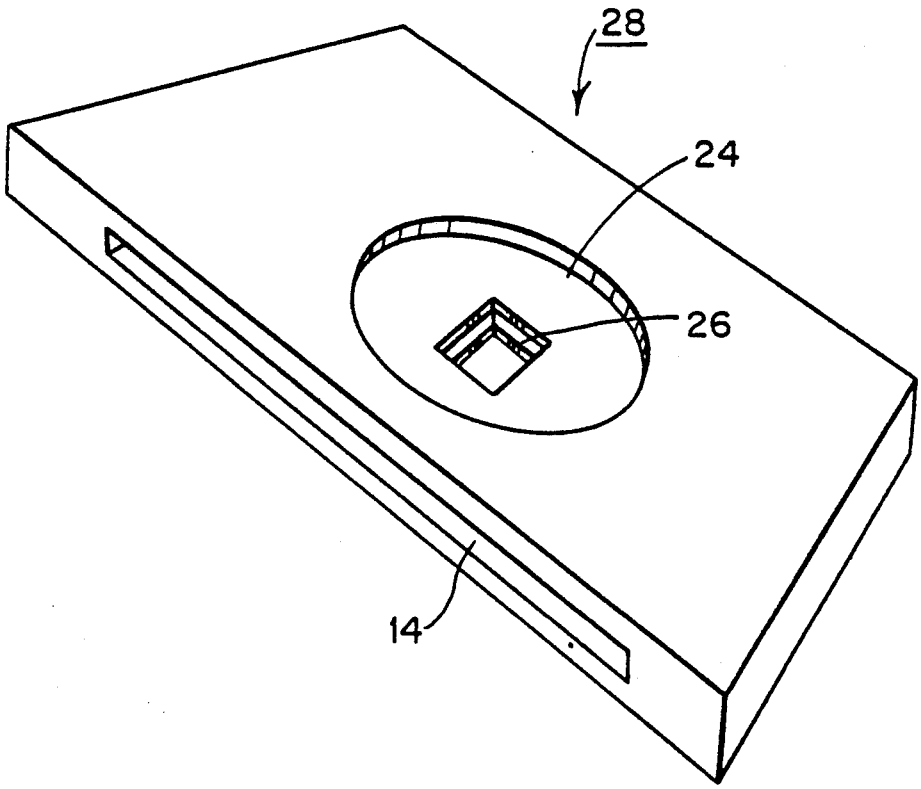
FIG. 10 is a front perspective view of the chamber of the parallel flow heat exchange chamber of the present invention.

Flue inlet 22 is in fluid communication with effluent passageway 13 and flue outlet 24. The parallel flow heat exchanger chamber 28 is located in a spaced fluid relationship between flue inlet 22 and flue outlet 24. Preferably, the walls defining the middle ar conduit of the parallel flow heat exchanger 10 has an inspection window 26. Parallel flow heat exchanger includes a housing 28 which is illustrated in FIGS. 9 and 10. The housing contains middle air passageway 14. Inspection window 26 permits the viewing of the flue outlet through the firechamber 27 and flue inlet 22.

Figure 1:
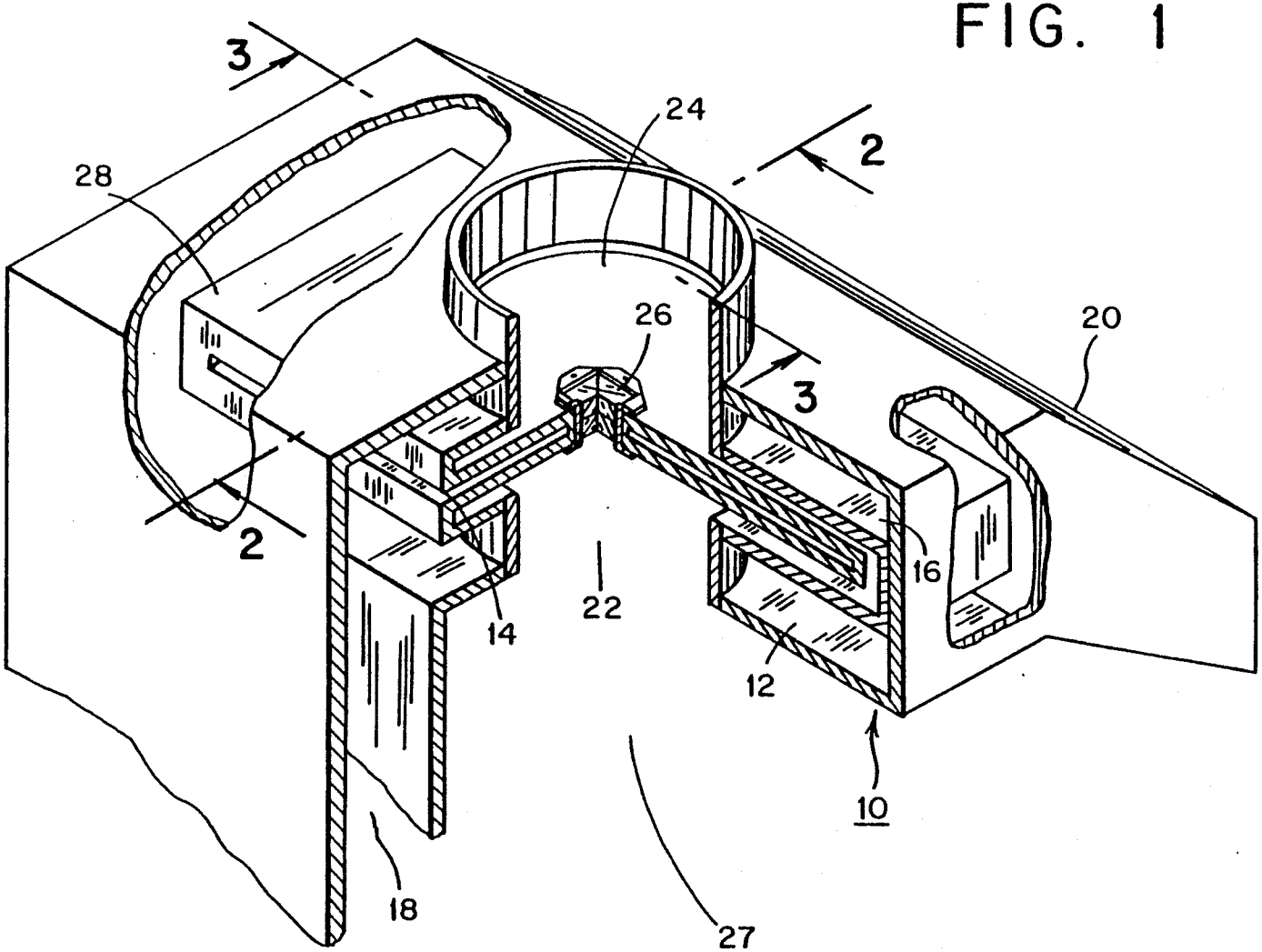
FIG. 1 is a rear perspective cutaway view of the parallel flow heat exchanger of the present invention installed in a fireplace unit.
Figure 2:
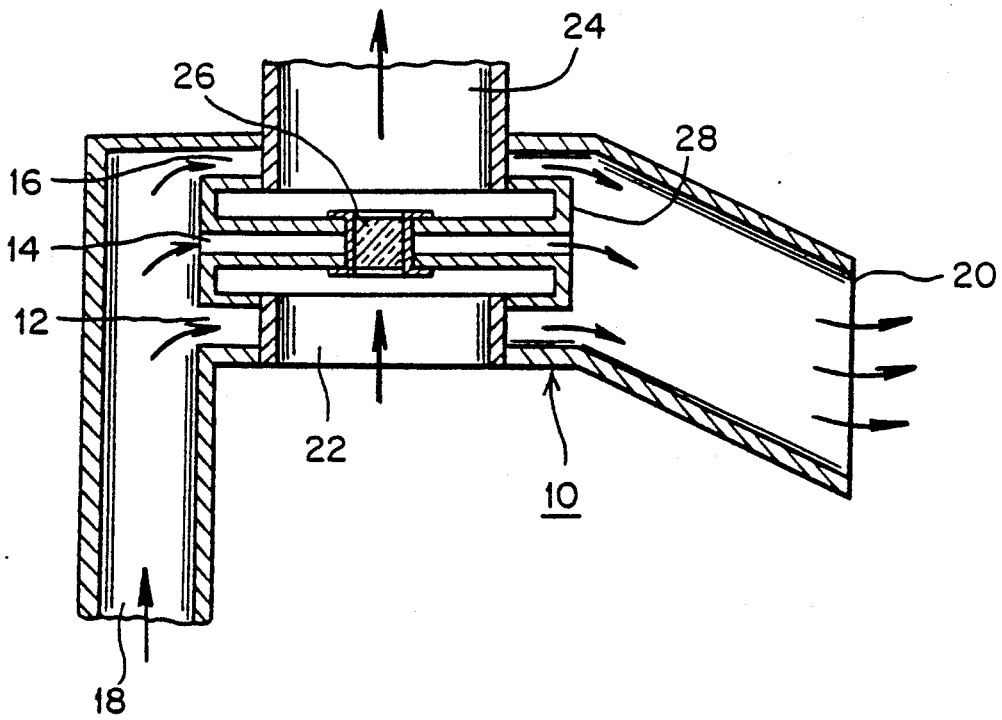
FIG. 2 is a sectional view of FIG. 1 across line 2—2.
Figure 3:
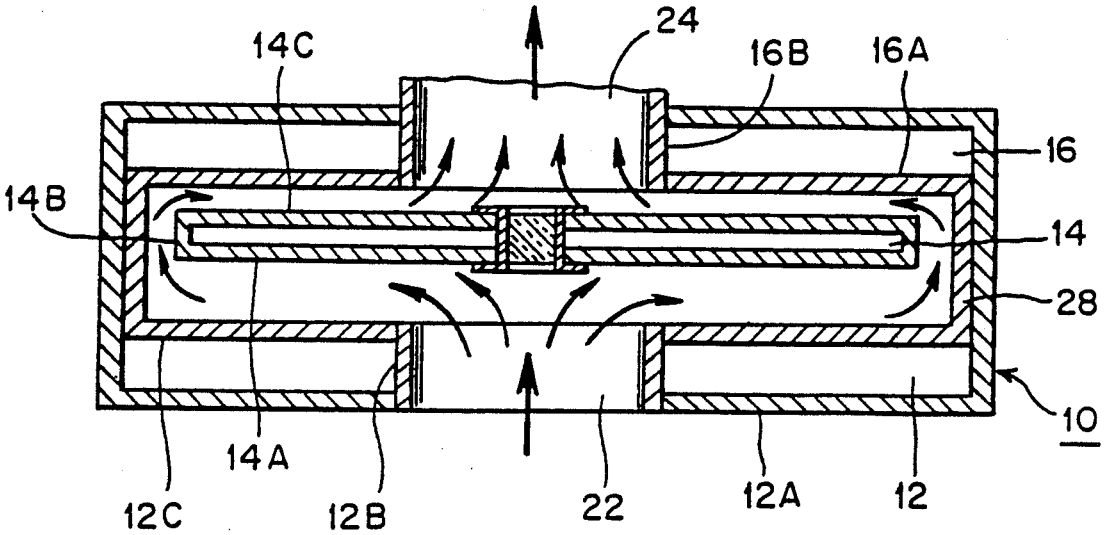
FIG. 3 is a sectional view of FIG. 1 across line 3—3.
Figure 4:
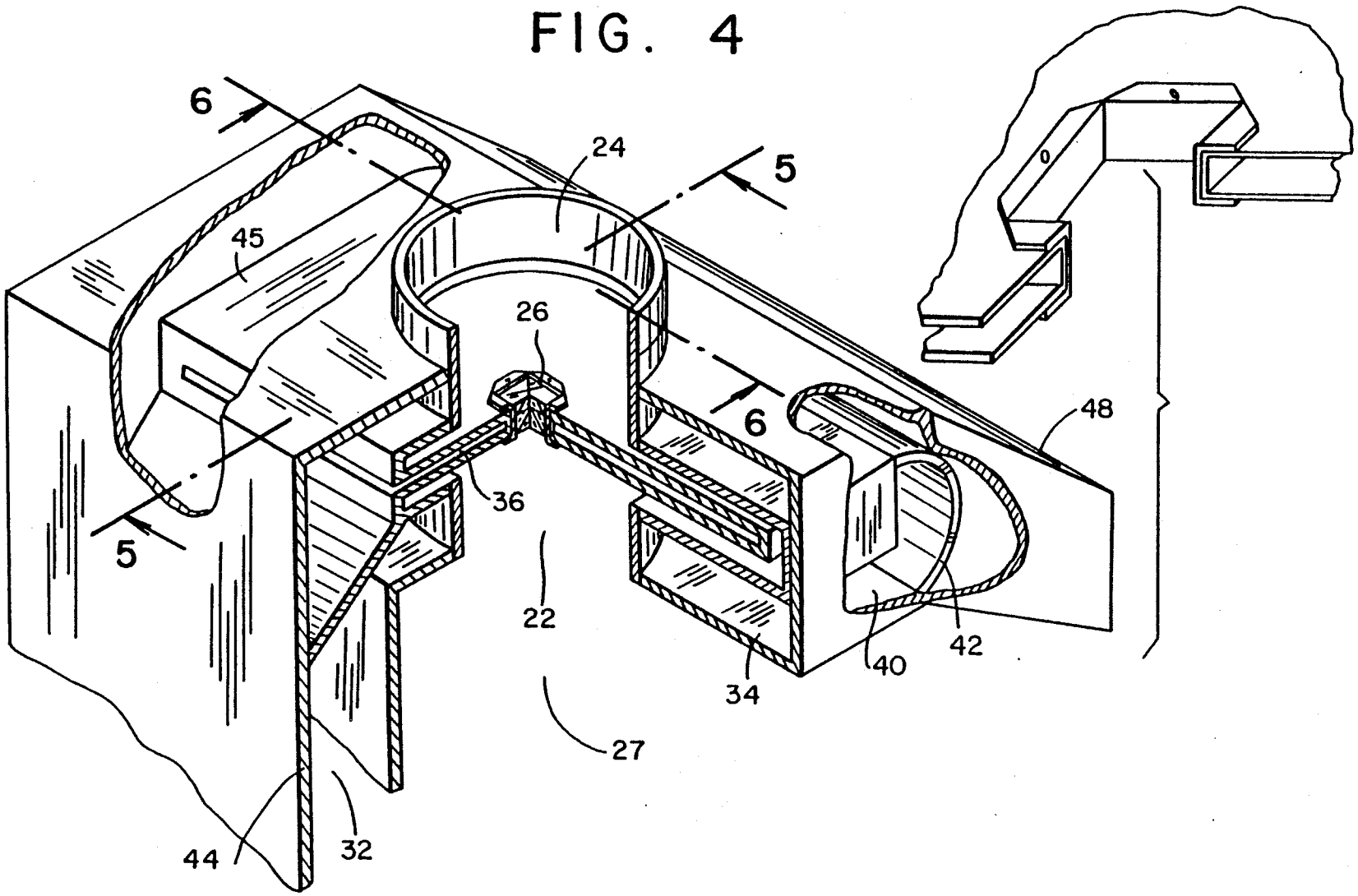
FIG. 4 is a rear perspective view of the sinusoidal passage heat exchanger of the present invention installed in a fireplace unit.

In operation, ambient air is introduced to lower air conduit 12, middle air conduit 14 and upper air conduit 16 through air inlet 19, base conduit 17 and rear conduit 18. Preferably, an air pump 31 is used to aid the flow of ambient air. As illustrated in FIGS. 2 and 3, the hot flue gas enters flue inlet 22, passes through effluent passageway 13, comes into contact with the lower wall 14A of middle air conduit 14 and is diverted to the left and right. The lower wall 14A bounding the middle air conduit 14 also functions as a diversion means (i.e., it diverts the flow of combustion chamber effluent to the left and right). The hot flue gas contacts lower wall 12A, side walls 12B and upper wall 12C of the lower air conduit 12 and transfers heat to these walls which transfer heat to ambient air within air conduit 12. The hot flue gas comes into contact with lower wall 14A, side walls 14B and upper wall 14C of middle air conduit 14 and transfers a large amount of heat to these walls which in turn transfer heat to ambient air within middle air conduit 14. The hot flue gas also contacts lower wall 16A of upper air conduit 16 transfers heat to this wall. Heat from walls 16A and 16B is then transferred to ambient air within air conduit 16. Air flowing through air conduits 12, 14 and 16 serves to cool the top 50 and front portion 52 of the fireplace.

The low pressure drop results from the tortuous path followed by the air to be heated. The tortuous path slows the rate of air flow. A high heat exchange results from the extensive heat exchange surface area provided by the diversion means and air conduits of the present invention. Air conduits 12, 14 and 16 and the diversion means reduce the necessary overall size of the parallel flow heat exchanger such that it can be inserted into a conventional gas or wood burning fireplace.

An alternative sinusoidal passage embodiment of the present invention is illustrated in FIGS. 4-6 and FIG. 8. The sinusoidal passage heat exchanger 30 produces a higher air pressure drop than the parallel flow heat exchanger and heats the air to a greater extent than the parallel flow heat exchanger.

The sinusoidal passage heat exchanger 30 includes a lower air conduit 34, a middle air conduit 36 and an upper air conduit 38. Middle air conduit 36 is contained within sinusoidal passage heat exchange chamber which is defined by the heat exchanger housing 37. Conduits 34, 36 and 38 are in continuous fluid communication with each other to form a sinusoidal air passage 40. Air outlet 48 is in fluid communication with upper air conduit 38 and serves to discharge heated air from the sinusoidal air passage 40.

Air inlet 19, base conduit 17 and rear conduit 18 are in fluid communication with the sinusoidal air passage 40 and serve to provide air to be heated to sinusoidal air passage 40. Preferably, an air pump 31 is provided to the flow of air through the passageways.

Figure 11:
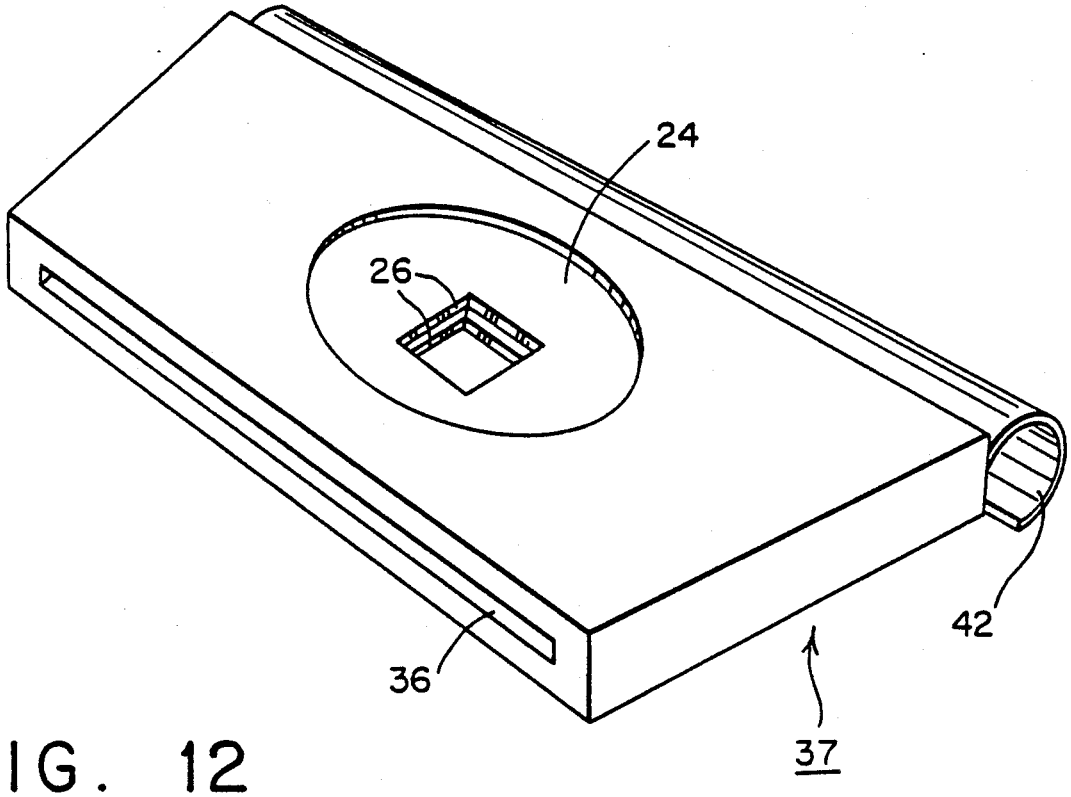
FIG. 11 is a back perspective view of the sinusoidal passage heat exchange chamber of the present invention.
Figure 12:
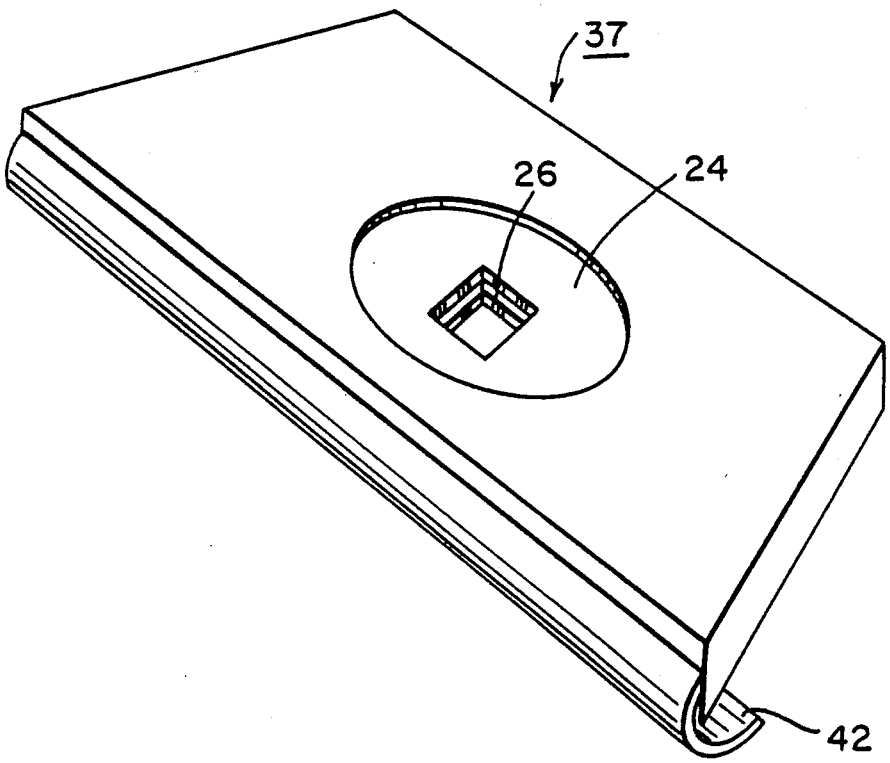
FIG. 12 is a front perspective view of the sinusoidal passage heat exchange chamber of the present invention.

Flue inlet 22 is in fluid communication with effluent passageway 35 and flue outlet 24. Sinusoidal passage heat exchange chamber 45 is located in a spaced fluid relationship between flue inlet 22 and flue outlet 24. Preferably, sinusoidal passage heat exchange chamber 45 has an inspection window 26. Sinusoidal passage heat exchange chamber 45 is illustrated in FIGS. 11 and 12. The inspection window 26 permits the viewing of the flue outlet through the firechamber 27 and flue inlet 22.

Figure 5:
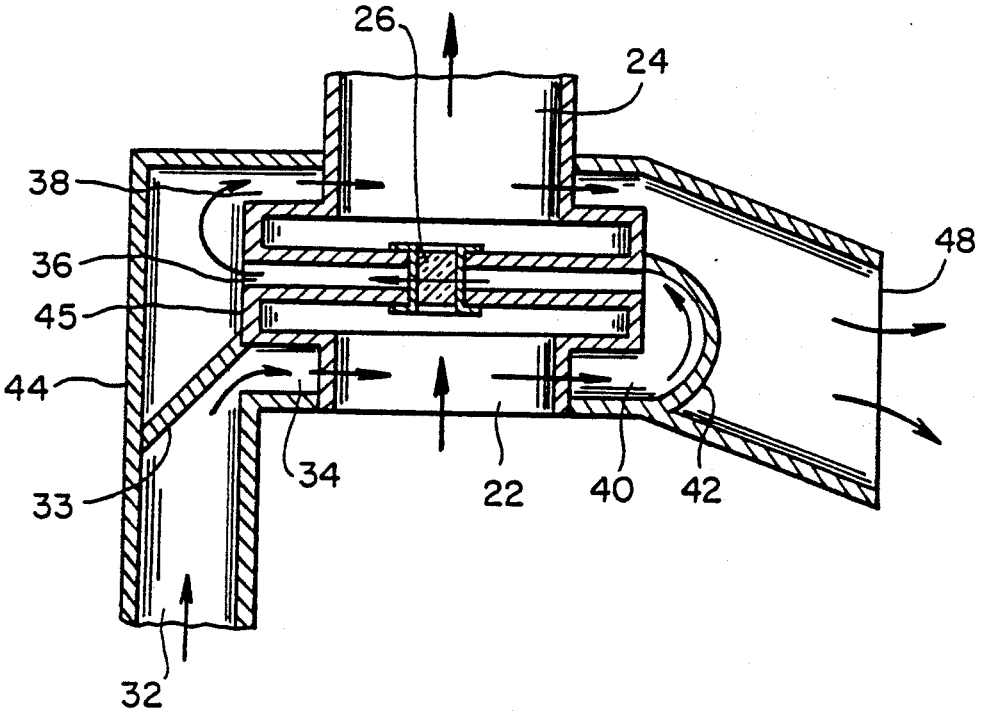
FIG. 5 is a sectional view of FIG. 4 across line 5—5.
Figure 6:
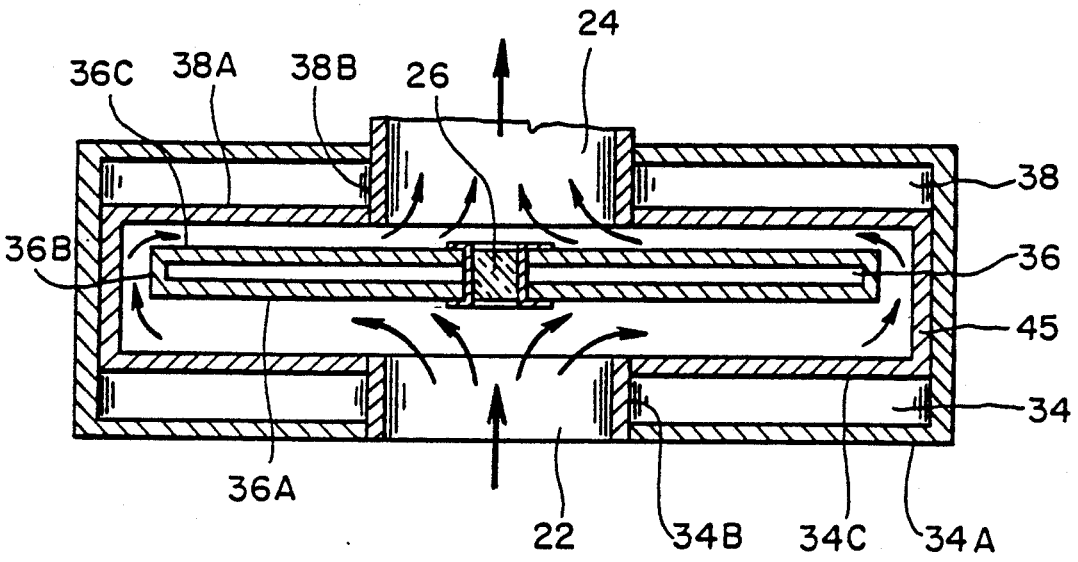
FIG. 6 is a sectional view of FIG. 4 across line 6—6.

As illustrated in FIGS. 5 and 6, the hot flue gas enters effluent passageway 35 and flue inlet 22, comes into contact with the lower outside wall 36A of middle air conduit 36 and is diverted to the left and right. The hot flue gas contacts lower wall 34A, side walls 34B and upper wall 34C of the lower air conduit 34 and transfers heat to these walls which transfer heat to ambient air within lower air conduit 34. The hot flue gas also comes into contact with lower wall 36A, side walls 36B and upper wall 36C of middle air conduit 36 and transfers heat to these walls which then transfer heat to ambient air within middle air conduit 34. The hot flue gas further contacts lower wall 38A and side walls 38B of upper air conduit 38 and transfers heat to these walls which then transfer heat to ambient air within upper air conduit 38.

In operation, ambient air is introduced into lower air passageway 34 through air inlet 19, base conduit 17 and rear conduit 18. Preferably, an air pump 31 is used to aid the flow of ambient air. The ambient air enters lower air conduit 34 and comes into contact with front reflection wall 42. The air then travels through middle air conduit 36. Baffle plate 33 separates air inlet 32 from middle air conduit 36. Air from middle conduit 36 reflects off of reflection wall 44 and enters upper air conduit 38. The air picks up heat from the flue gas in the aforementioned manner. The heated air is then discharged to an area to be heated through hot air outlet 48. The low pressure drop results from the tortuous path followed by the air to be heated which slows the rate of air flow. A high heat exchange results from the extensive heat exchange surface area provided by the present invention. The sinusoidal passage and the diversion means reduce the necessary overall size of the sinusoidal passage heat exchanger such that it can be inserted into a conventional gas or wood burning fireplace.

Thus, while there have been described what are the presently contemplated preferred embodiments of the invention, further changes and modifications should be made by those skilled in the art without departing from the scope of the invention, and it is contemplated to claim all such changes and modifications.

What is claimed is:

1. A fireplace assembly comprising:

a housing;

a firechamber within said housing;

a flue inlet in fluid communication with said firechamber;

a heat exchanger positioned above said flue inlet, the heat exchanger including lower, middle and upper air conduits, arranged in substantially parallel relation to each other, said air conduits being bounded by first second and third sets of spaced upper and lower, generally horizontal walls, respectively, the lower wall of said middle air conduit being positioned directly above said flue inlet such that when combustion takes place in said firechamber, flue gas passing through said flue inlet is deflected by said lower wall of said middle conduit in at least two opposing directions as the flue gas enters the heat exchanger;

means for introducing fresh air to said lower, middle and upper air conduits;

means for causing flue gas to contact at least one of the walls of each of said sets of walls bounding said respective air conduits;

an air outlet for discharging air from said air conduits; and a flue outlet for discharging flue gas from said heat exchanger.

2. An assembly as described in claim 1 wherein said means for introducing fresh air and said air outlet are arranged such that fresh air is caused to flow in parallel through said first, second and third air conduits from said means for introducing fresh air to said air outlet.

3. An assembly as described in claim 1 including means for causing fresh air to travel sinusoidally through said lower, middle and upper air conduits as the fresh air travels from said means for introducing fresh air to said air outlet.

4. An assembly as described in claim 3 wherein said first, second and third sets of walls are arranged such that, when combustion takes place in said firechamber, flue gas from the flue inlet contacts the upper wall of the lower air conduit, the upper and lower wall of the middle air conduit, and the lower walls of the upper air conduit.

5. An assembly as described in claim 4 wherein the lower wall of the lower air conduit and the upper wall of the middle air conduit are connected by an arcuate wall for directing air from the lower air conduit to the middle air conduit.

6. An assembly as described in claim 4 including an inspection window secured to at least one of the upper and lower walls bounding the middle air conduit, the inspection window allowing the viewing of the flue outlet via the flue inlet.

7. An assembly as described in claim 4 wherein said means for introducing fresh air includes a generally vertically extending conduit adjoining a rear wall of said firechamber.

8. An assembly as described in claim 4 wherein the lower wall of the lower air conduit defines an upper wall of the firechamber.

9. An assembly as described in claim 2 wherein said first, second and third sets of walls are arranged such that, when combustion takes place in said firechamber, flue gas from the flue inlet contacts the upper wall of the lower air conduit, the upper and lower walls of the middle air conduit, and the lower wall of the upper air conduit.

10. An assembly as described in claim 9 wherein the lower, middle and upper air conduits extend generally parallel to the air outlet, each of the air conduits including a discharge end communicating directly with the air outlet.

11. An assembly as described in claim 9 including an inspection window secured to at least one of the upper and lower walls bounding the middle air conduit, the inspection window allowing the viewing of the flue outlet via the flue inlet.

12. An assembly as described in claim 9 wherein said means for introducing fresh air includes a generally vertically extending conduit adjoining a rear wall of said firechamber.

13. An assembly as described in claim 2 wherein said heat exchanger includes a plurality of vertically extending walls connecting the lower wall of the upper air conduit and the upper wall of the upper wall of the lower air conduit, said vertically extending walls adjoining the housing of the fireplace assembly.

14. An assembly as described in claim 9 wherein the lower wall of the lower air conduit defines an upper wall of the firechamber.

15. A heat exchanger assembly for use with a fireplace, comprising:

a heat exchanger housing including a top wall, a bottom wall, and a plurality of side walls connecting said top and bottom wall, said top, bottom and side walls defining a chamber;

a set of upper and lower walls connected to said side walls of said housing and defining an air conduit within said chamber, said air conduit being isolated from said chamber such that gas within said chamber will not mix with air within said air conduit, said upper and lower walls of said air conduit being generally parallel to the top and bottom walls of the housing;

a first opening within the bottom wall of said housing and communicating with said chamber, said first opening being in opposing relation to the lower wall of said air conduit;

a second opening within the top wall of said housing and communicating with said chamber;

an inlet opening within one of said side walls of said housing for admitting air to said air conduit; and an outlet opening within one of said side walls of said housing for allowing air to exit said air conduit, whereby heated flue gas entering said first opening will be deflected in opposing directions by said lower wall of said air conduit towards the side walls of said chamber, turned about one hundred eighty degrees as the flue gas moves from beneath the ar conduit to above the air conduit, and caused to exit through the second opening.

16. An assembly as described in claim 15 including an inspection window secured to at least one of the upper and lower walls of the air conduit, the inspection window being in alignment with the first and second openings.

17. An assembly as described in claim 15 wherein said first opening is in substantial vertical alignment with said second opening.

* * * * *